US006556170B2

(12) United States Patent
Northey

(10) Patent No.: US 6,556,170 B2
(45) Date of Patent: Apr. 29, 2003

(54) RETRACTABLE AND ROTATABLE ANTENNA FOR AN ELECTRONIC CARD

(75) Inventor: William A. Northey, Etters, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 09/824,475

(22) Filed: Apr. 2, 2001

(65) Prior Publication Data

US 2002/0140614 A1 Oct. 3, 2002

(51) Int. Cl.[7] ..... H01Q 1/38
(52) U.S. Cl. ..... 343/700 MS; 343/702; 343/846; 343/906; 455/90
(58) Field of Search ..... 343/702, 700 MS, 343/846, 906, 830, 848; 455/90, 348, 557, 575

(56) References Cited

U.S. PATENT DOCUMENTS

| | | | | |
|---|---|---|---|---|
| 5,361,061 | A | 11/1994 | Mays et al. | 340/825.44 |
| 5,373,149 | A | 12/1994 | Rasmussen | 235/492 |
| 5,510,959 | A | 4/1996 | Derstine et al. | 361/816 |
| 5,559,501 | A | 9/1996 | Barzegar et al. | 340/825 |
| 5,606,732 | A | 2/1997 | Vignone, Sr. | 455/269 |
| 5,644,320 | A | 7/1997 | Rossi | 343/702 |
| 5,646,635 | A | 7/1997 | Cockson et al. | 343/702 |
| 5,657,028 | A | 8/1997 | Sanad | 343/700 |
| D402,662 | S | 12/1998 | Low et al. | D14/238 |
| 5,913,174 | A | 6/1999 | Casarez et al. | 455/557 |
| 5,914,696 | A | 6/1999 | Vanederhelm et al. | 343/841 |
| 5,918,163 | A | 6/1999 | Rossi | 455/90 |
| 5,936,584 | A | 8/1999 | Lawrence et al. | 343/702 |
| 5,946,194 | A | 8/1999 | Dudas et al. | 361/737 |
| 5,949,379 | A | 9/1999 | Yang | 343/702 |
| 5,963,872 | A | 10/1999 | Stein | 455/557 |
| 5,970,402 | A | 10/1999 | Vermeer | 455/347 |
| 6,005,700 | A | 12/1999 | Pressler et al. | 359/172 |
| 6,016,432 | A | 1/2000 | Stein | 455/557 |
| 6,018,461 | A | 1/2000 | Biermann et al. | 361/737 |
| D425,072 | S | 5/2000 | Dosch et al. | D14/242 |
| 6,058,018 | A | 5/2000 | Gerrots et al. | 361/737 |
| 6,160,711 | A | 12/2000 | Gerrits et al. | 361/737 |
| 6,164,989 | A | 12/2000 | Glad et al. | 439/131 |
| 6,172,645 | B1 | 1/2001 | Hollander et al. | 343/702 |
| 6,259,409 | B1 | 7/2001 | Fulton et al. | 343/702 |
| 6,259,418 | B1 * | 7/2001 | Jones et al. | 343/846 |
| 6,266,017 | B1 * | 7/2001 | Aldous | 343/702 |
| 6,292,146 | B1 * | 9/2001 | Melax | 343/702 |
| 6,292,148 | B1 * | 9/2001 | Matsuura et al. | 343/702 |
| 6,292,152 | B1 | 9/2001 | Cosenza et al. | 343/745 |
| 6,295,031 | B1 * | 9/2001 | Wallace et al. | |
| 451,501 | A1 | 12/2001 | Sward et al. | D14/242 |
| 6,327,154 | B1 | 12/2001 | Gauld et al. | 361/737 |
| 6,419,506 | B2 * | 7/2002 | Jones et al. | 343/702 |

FOREIGN PATENT DOCUMENTS

| | | |
|---|---|---|
| WO | 98/20451 | 5/1998 |

OTHER PUBLICATIONS

U.S. patent 09,578,102, issue date May 24, 2000.

* cited by examiner

*Primary Examiner*—Hoang Nguyen
(74) *Attorney, Agent, or Firm*—Woodcock Washburn LLP

(57) ABSTRACT

An assembly for an electronic card includes an end piece, a guide plate, a slide mechanism, and a member rotatably coupled to the slide mechanism. The end piece is for connection to the electronic card. The end piece has an internal side, an external side, and an aperture. The guide plate is coupled to the internal side of the end piece and adjacent to the aperture. The guide plate has a first recess and a second recess. The slide mechanism is located at least partially in the guide plate, and includes a detent. The slide mechanism has an extended position and a retracted position. In the extended position the detent is engaged in the second recess, in the retracted position the detent is engaged in the first recess. Disengaging the detent from either of the first recess and the second recess allows sliding the slide mechanism between the extended position and the retracted position. A member is rotatably coupled to the slide mechanism. The member may be an antenna.

38 Claims, 7 Drawing Sheets

RETRACTABLE AND ROTATABLE ANTENNA FOR AN ELECTRONIC CARD

FIELD OF THE INVENTION

The present invention relates to an antenna for an electronic card. More particularly, the present invention relates to a retractable and rotatable antenna that can lock in an extended position and a retracted position, for use in an electronic device, such as a notebook computer.

BACKGROUND OF THE INVENTION

It has become increasingly popular to provide an electronic device with a slot for receiving an electronic package or 'card' that provides additional functionality to the device. For example, in connection with portable personal computers (e.g., 'laptops' or 'notebooks') and other portable electronic devices, it has become commonplace to add functionality merely by inserting a Personal Computer (PC) card, such as that defined by the Personal Computer Memory Card International Association (PCMCIA), with appropriate hardware and/or software into a PC card slot on such a device. For example, the device can be provided with extra memory, extra processing capabilities, extra applications, and/or other features. Likewise, the device can be provided with add-on hardware such as an Ethernet connection, a land-line modem, a hard or floppy disk drive, a wireless modem, and the like.

Most PC cards are built according to standards set forth by the PCMCIA. Such standards provide (among other things) physical specifications for three types of PC Cards, with additional provisions for extended cards. All three card types measure the same length and width and use a standard 68-position receptacle connector at one longitudinal end to mate with a corresponding 68-pin header connector within the PC card slot defined in the electronic device. The main difference between the card types is thickness. In particular, Type I, Type II, and Type III cards are 3.3, 5.0, and 10.5 millimeters thick, respectively. Because they differ only in thickness, a thinner card can be used in a thicker slot, but a thicker card cannot be used in a thinner slot. The card types each have features that fit the needs of different applications. Type I PC Cards are typically used for memory devices such as Random Access Memory (RAM), Flash Memory, One Time Password (OTP), and Static Random Access Memory (SRAM) cards. Type II PC Cards are typically used for Input/Output (I/O) devices such as data/fax modems, Local Area Networks (LANs), and mass storage devices. Type III PC Cards are often used for devices whose components are thicker, such as rotating mass storage devices.

An extended card has a length longer than a standard PCMCIA card. An extended card may be a Type I, II, or III card. An extended card, because of the additional length, includes a portion (i.e., the exterior portion) of the card that extends beyond the slot of the electronic device. Extended cards typically allow the addition of components that must remain outside of an electronic device or outside of a metallic shell of an extended card for proper operation, such as antennas for wireless applications.

Typically, an enclosure for an electronic card is formed by combining upper and lower half shells, thereby defining an interior within which functional elements of the electronic card may reside. Also, typically, functional elements are sandwiched between the upper and lower half shells during the formation of the enclosure. Additionally, the enclosure is typically provided with an open end at one longitudinal end of the enclosure. Often, the enclosure is provided with an end piece or cap to cover the open end, and the end piece or cap may be provided with appropriate apertures for access to the interior, if necessary.

For wireless applications, such as wireless LAN, the electronic card is typically provided with an antenna. The antenna is used to communicate with other wireless electronic devices by using electromagnetic waves. These waves are both received and sent by the antenna and converted to and from digital signals compatible with the electronic operation of the notebook computer. The transmission and reception of the electromagnetic waves is dependent on the orientation of the antenna. If the antenna is in a non-optimal orientation, the communication between the electronic device (e.g., notebook computer) and other wireless electronic devices may include transmission errors.

The optimal antenna orientation for communication may be horizontal, vertical, or some other orientation. Moreover, the optimal orientation may depend on the location and orientation of the other electronic devices, the orientation of the antenna of the other electronic devices, as well as other factors. For example, in one location the optimal orientation for the antenna may be horizontal and in another location the optimal orientation may be vertical. Therefore, a rotatable antenna is desirable.

Providing an antenna in connection with the electronic card provides challenges in designing for both functionality and robustness. As described above, it is desirable that the antenna be adjustable so that communication between the notebook computer and other wireless electronic devices may be optimized. That is, the optimal antenna orientation provides a minimum amount of communication errors. Additionally, it is desired that the antenna be designed with robustness in mind. Robustness is especially important if the electronic card is installed in a notebook computer. Notebook computers typically experience harsher treatment than desktop computers. For example, notebook computers frequently are moved from one location to another, taken on business trips, carried back and forth to work, and the like. Because of the portability of the notebook computer, a robust design of an electronic card is desired, especially for the antenna, which is likely to be bent or otherwise damaged during transport of the notebook computer.

One type of antenna for an electronic card is provided in an extended card for a notebook computer. In this case, the antenna typically is located in the exterior portion of the card. This permits the antenna to send and receive electrical signals with other wireless electronic devices while incurring minimal electrical interference with internal components of the notebook computer. Also, the antenna is protected by the exterior portion of the card. However, the exterior portion of the card is not adjustable and therefore, the orientation of the antenna is fixed. As such, the antenna may not be in an optimal orientation and errors may be encountered in the communication of electronic signals between the antenna and other wireless electronic devices.

While locating the antenna in an extended card provides protection for the antenna, placing the antenna outside of an electronic card increases the risk of damage to the antenna during transport of the notebook computer.

Accordingly, a need exists for an electronic card with an antenna that allows the orientation of the antenna to be adjusted with respect to the electronic card and also protects the antenna when not in use.

SUMMARY OF THE INVENTION

The present invention satisfies the aforementioned need by providing an assembly including an antenna rotatably and retractably coupled to an end piece of an electronic card.

According to an aspect of the present invention, the antenna has a retracted position and an extended position. In the retracted position, the antenna is located adjacent to the electronic card, thereby protecting the antenna from damage. In the extended position, the antenna is spaced apart from the electronic card allowing the antenna to be rotated and allowing a user to adjust the orientation of the antenna for optimal transmission and reception of electromagnetic waves.

According to another aspect of the present invention, the antenna is coupled to a slide mechanism. The slide mechanism includes a detent for locking the antenna in either one of the retracted position and the extended position. The detent may be released from being locked in a position by biasing a detent member. Alternatively, the detent may be released from being locked in a position by biasing the antenna.

According to a further aspect of the present invention, an assembly is provided for an electronic card including an end piece, a guide plate, a slide mechanism, and a member rotatably coupled to the slide mechanism. The end piece is for connection to the electronic card. The end piece has an internal side, an external side, and an aperture. The guide plate is coupled to the internal side of the end piece and adjacent to the aperture. The guide plate has a first recess and a second recess. The slide mechanism is located at least partially in the guide plate, and includes a detent. The slide mechanism has an extended position and a retracted position. In the extended position the detent is engaged in the second recess, in the retracted position the detent is engaged in the first recess. Disengaging the detent from either of the first recess and the second recess allows sliding the slide mechanism between the extended position and the retracted position. A member is rotatably coupled to the slide mechanism. The member may be an antenna.

The above-listed features, as well as other features, of the present invention will be more fully set forth hereinafter.

BRIEF DESCRIPTION OF THE DRAWINGS

The foregoing summary as well as the following detailed description of the present invention will be better understood when read in conjunction with the appended drawings. For the purpose of illustrating the invention, the drawings show exemplary embodiments. As should be understood, however, the invention is not limited to the precise arrangements and instrumentalities shown. In the drawings.

DETAILED DESCRIPTION OF THE INVENTION

Figure 1:
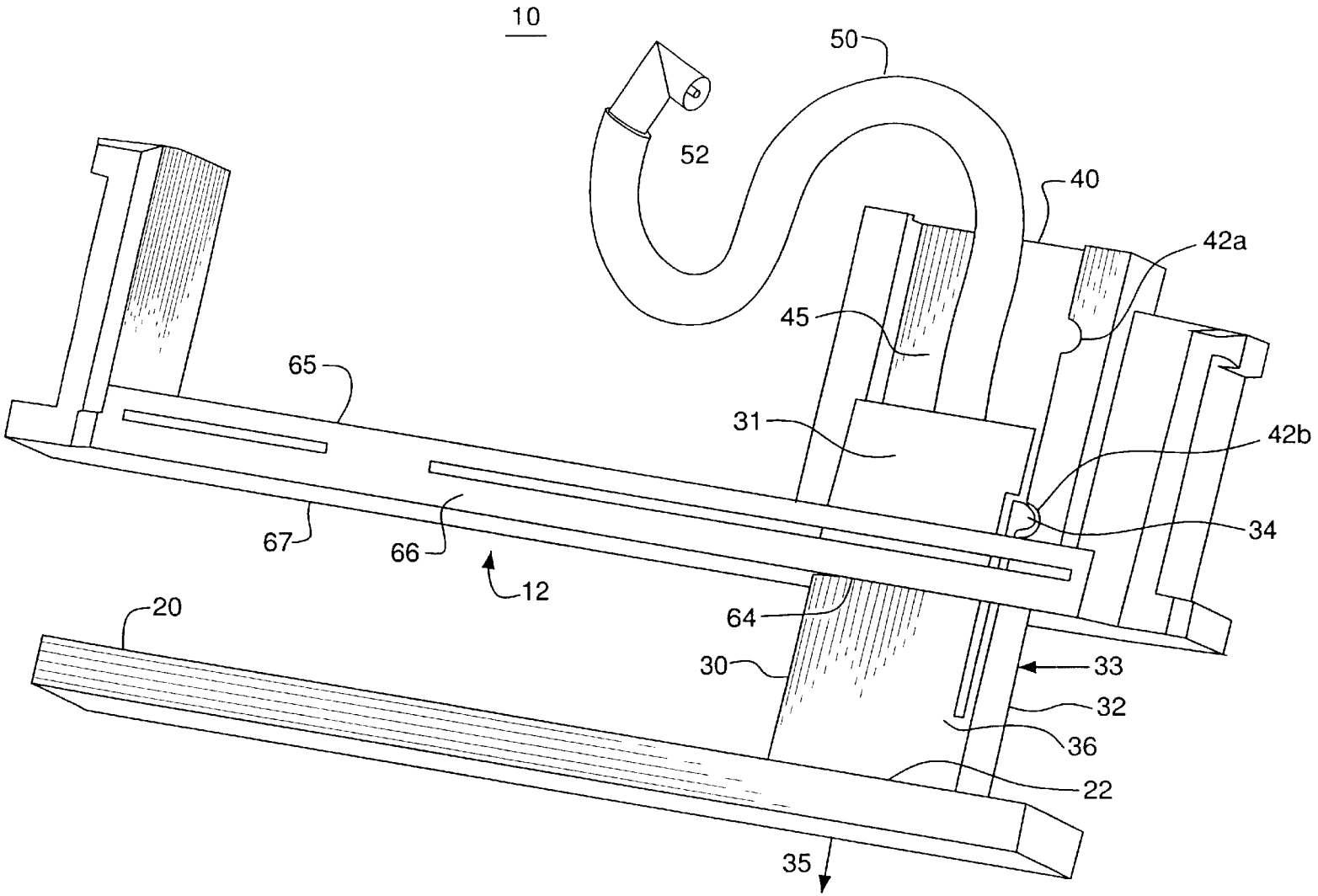
FIG. 1 is a perspective view of an assembly including an end piece of an electronic card, an antenna, and a slide mechanism, in accordance with one embodiment of the present invention.

Certain terminology may be used in the following description for convenience only and is not considered to be limiting. For example, the words "left", "right", "upper", and "lower" designate directions in the drawings to which reference is made. Likewise, the words "inwardly" and "outwardly" are directions toward and away from, respectively, the geometric center of the referenced object. The terminology includes the words above specifically mentioned, derivatives thereof, and words of similar import.

Referring to the drawings in detail, wherein like numerals are used to indicate like elements throughout, there is shown in FIG. 1 an assembly 10 including an end piece 12, a guide plate 40, a slide mechanism 30, and an antenna 20 rotatably coupled to the slide mechanism 30.

Figure 4:
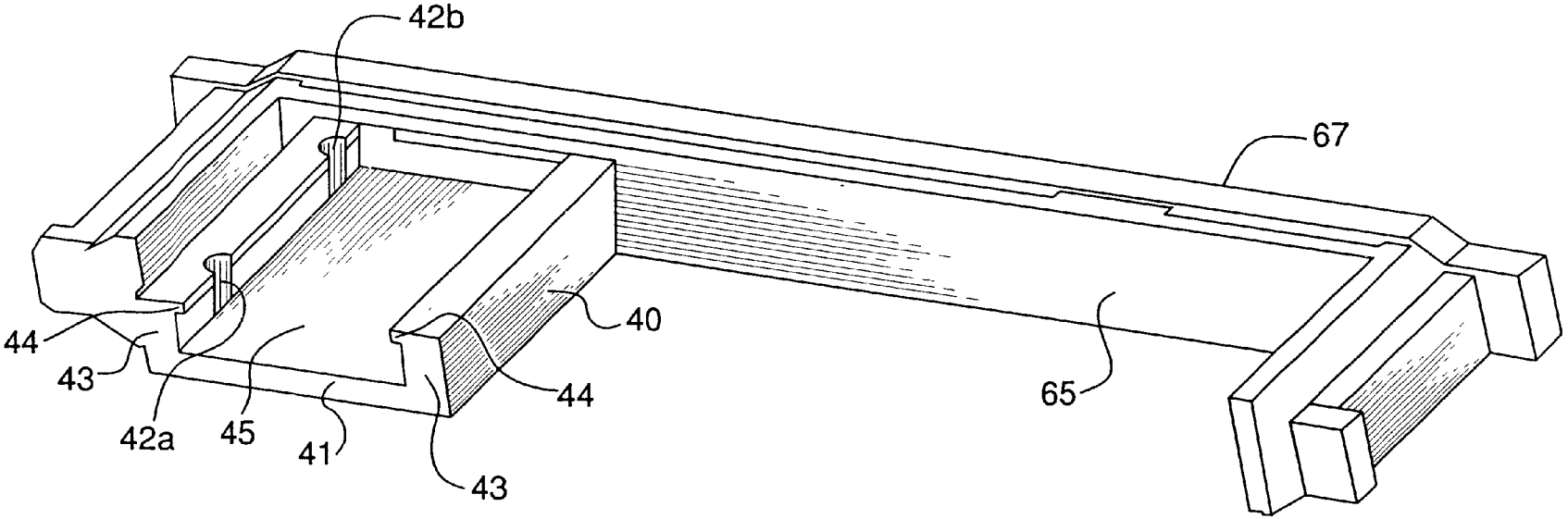
FIG. 4 is a perspective view of the end piece of the assembly of FIG. 1 illustrating an interior side of the end piece, in accordance with one embodiment of the present invention.
Figure 5:
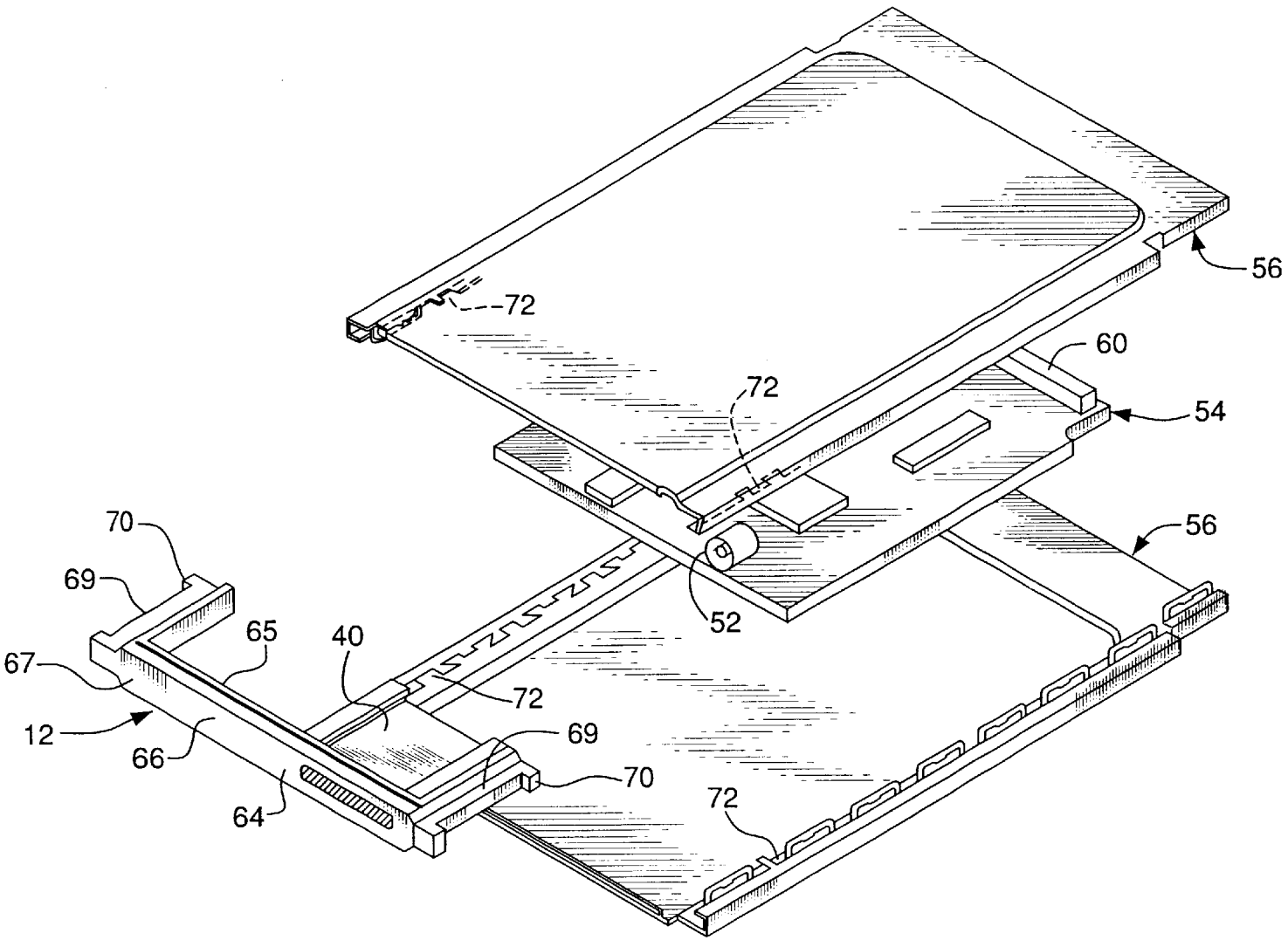
FIG. 5 is an exploded perspective view of an electronic card enclosure including the assembly of FIG. 1, in accordance with one embodiment of the present invention.
Figure 6:
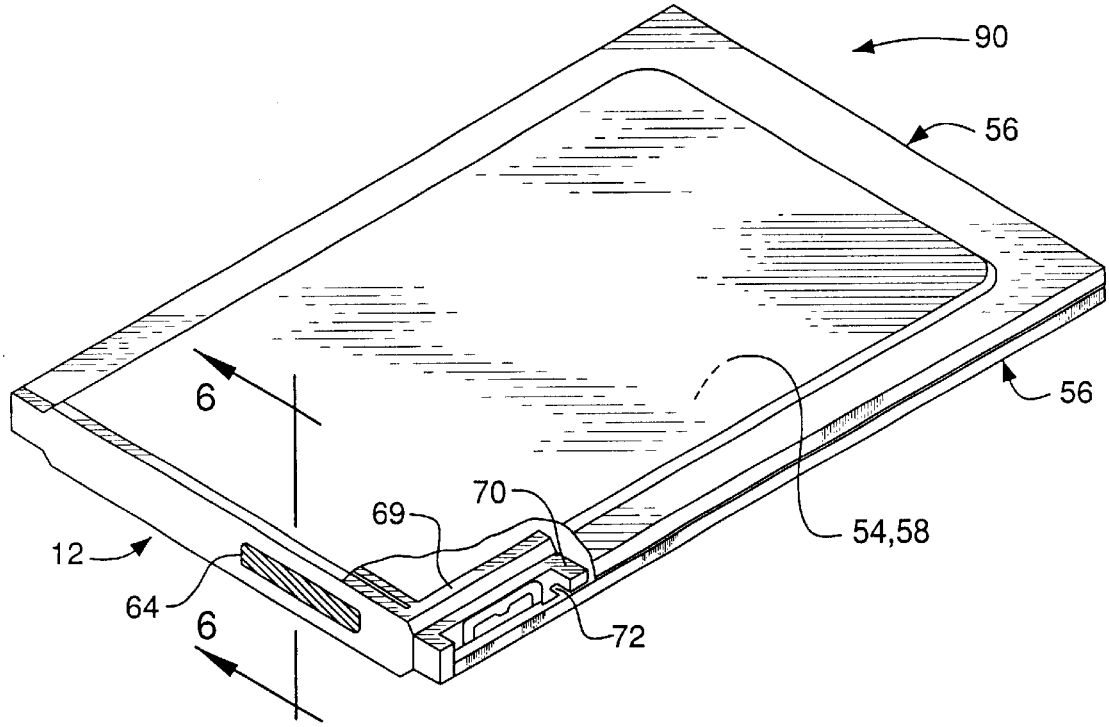
FIG. 6 is a non-exploded perspective view of the enclosure and a portion of the assembly of FIG. 1, in accordance with one embodiment of the present invention.

End piece 12 includes a cover section 66 for covering an open end of an electronic card. Cover section 66 has an internal side 65 and an external side 67. As best seen in FIG. 5 and FIG. 6, end piece 12 closes an enclosure 90 at an open longitudinal end thereof. Therefore, end piece 12 is provided with an aperture 64 for slide mechanism 30, as best seen in FIG. 4. End piece 12 further includes guide plate 40.

As shown in FIG. 4, guide plate 40 is substantially rectangular and has a void 45. Guide plate 40 has a base section 41 which is substantially planar. Two opposing ends of base section 41 each have a first rectangular projection 43 extending up from the base section 41 parallel to each opposing end, the top of the first rectangular projection 43 being distal from base section 41 and the bottom of first rectangular projection 43 being proximate to and in contact with base section 41. A second rectangular projection 44 extends from the top of each rectangular projection 43, inwardly with respect to base section 41 and parallel to base section 41. Base section 41, first rectangular projections 43, and second rectangular projections 44 form a substantially rectangular void 45.

In an alternate embodiment, second rectangular projection 44 may be omitted. In this alternate embodiment, base section 41, first rectangular projections 43, and half shell 56 (FIG. 5) form void 45.

In another alternate embodiment, second rectangular projection 44 may be omitted. In this alternate embodiment, base section 41, first rectangular projections 43, and cover section 66 form void 45.

Guide plate 40 is coupled to internal side 65 of cover section 66, adjacent to aperture 64, void 45 being contiguous with aperture 64. While void 45 is illustrated in the present embodiment as a rectangular void, it is anticipated that void 45 may be any shape that will accommodate a correspondingly shaped slide mechanism 30, thereby allowing the slide mechanism to move along an axis. For example, void 45 and slide mechanism 30 may be substantially round, square, elliptical, and the like.

One of the first rectangular portions 43 includes a first recess 42*a* distal from cover section 66, and a second recess 42*b* proximate to cover section 66, both recesses 42*a* and 42*b* are proximate to and contiguous with void 45. However, it is anticipated that first and second recess 42*a*, 42*b* may be located in other portions of guide plate 40, in half shell 56, and the like. In one embodiment, first recess 42*a* and second recess 42*b* are rounded, however, alternate embodiments are described below.

In one embodiment, end piece 12 is formed as a substantially unitary body. End piece 12 may be formed from an insulating material such as a polycarbonate, although any other material may be employed without departing from the spirit and scope of the present invention. End piece 12 may be formed by any appropriate operation or series of operations, again without departing from the spirit and scope of the present invention. For example, end piece 12 may be molded into its final form, or may be stamped from a sheet of material and then perhaps appropriately bent. It may be advantageous to form end piece 12 from a conductive material or with a metallized surface such as a metallized plastic in order that end piece 12 can act as a shield at the open end of the enclosure. Conversely, it may also be advantageous to form end piece 12 from a non-conductive material in order that end piece 12 not short any devices in electrical package 54 or any connector connecting thereto.

As shown in FIG. 1, slide mechanism 30 is substantially rectangular and substantially similar in size to void 45. Slide mechanism 30 is located at least partially in void 45 and extends through aperture 64. In this manner, guide plate 40 acts as a guide, allowing slide mechanism 30 to move along an axis. Motion along the axis allows slide mechanism 30 to extend and retract relative to cover section 66.

Slide mechanism 30 includes an interior portion 31 and an exterior portion 36. Interior portion 31 is located proximate to the interior of enclosure 90 and exterior portion 36 is located proximate the exterior of enclosure 90.

Slide mechanism 30 includes a detent member 32 having a detent 34 at one end thereof. Detent member 32 has a first end connected to exterior portion 36 of slide mechanism 30. Detent member 32 is located substantially parallel to a side of slide mechanism 30 and extends toward interior portion 31 of slide mechanism 30, culminating in a second end. The second end of detent member 32 includes detent 34. In one embodiment, detent 34 is rounded in a manner similar to recesses 42*a* and 42*b* such that detent 34 may engage into recess 42*a* or 42*b*.

Figure 2:
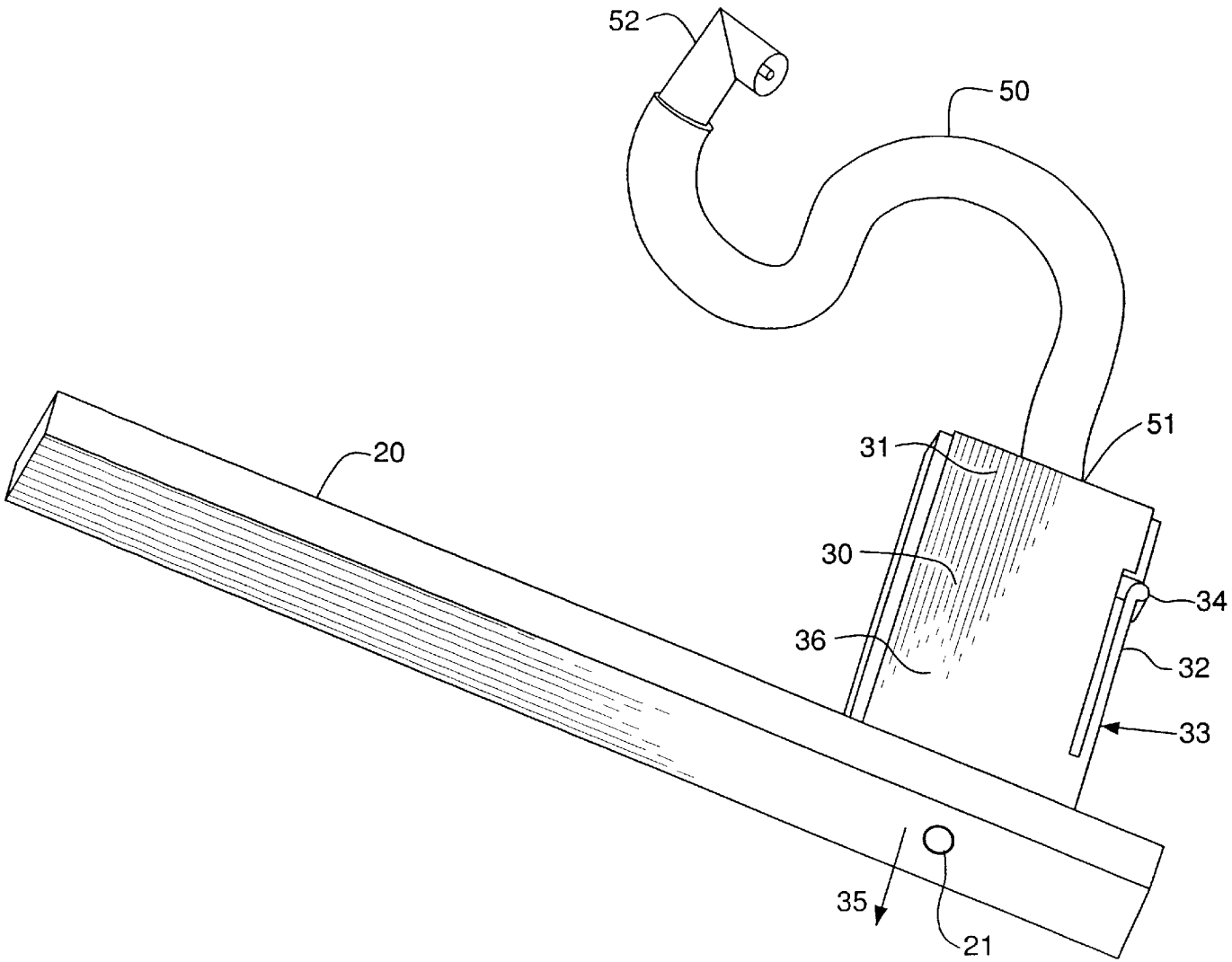
FIG. 2 is a perspective view of the antenna and slide mechanism of the assembly of FIG. 1, in accordance with one embodiment of the present invention.

As shown in FIG. 2, slide mechanism 30 includes a void proximate to detent member 32 wherein detent member 32 can be biased (shown by arrow 33) and thereby extend into the void. Accordingly, when detent member 32 is biased, detent 34 is biased away from, and is disengaged from recess 42*a* or 42*b*.

In this manner, slide mechanism 30 may have an extended position and a retracted position relative to guide plate 40, as best seen in FIG. 1. In the retracted position, detent 34 is engaged in first recess 42*a*. In the extended position, detent 34 is engaged in second recess 42*b*. Detent 34 may be disengaged from either first recess 42*a* or second recess 42*b* by biasing detent member 32 along arrow 33. Accordingly, when detent 34 is disengaged from either first recess 42*a* or second recess 42*b*, slide mechanism 30 may move between the extended position and the retracted position.

While in the present embodiment, one detent 34 is illustrated, it is anticipated that there may be a plurality of detents 34. For example, there may be two detent members 32, one on each opposing side of slide mechanism 30, each detent member 32 including a detent 34.

Moreover, detent 34 may be coupled to slide mechanism 30 without a detent member 32. In one embodiment, detent 34 is coupled to slide mechanism by a spring. In another embodiment, detent 34 and/or slide mechanism 30 is partially compliant, wherein detent 34 may be disengaged from recess 42*a* or 42*b* by biasing slide mechanism along arrow 35.

In one embodiment, detent 34 is rounded and recesses 42*a* and 42*b* are similarly rounded, such that biasing slide mechanism 30 along arrow 35 will bias detent member 32 along arrow 33, thereby allowing slide mechanism 30 to extend from enclosure 90. That is, antenna 20 may be extended by biasing slide mechanism 30 or antenna 20, in a direction away from cover section 66, which in turn disengages detent 34 from recess 42*a*.

Antenna 20 may be retracted by biasing antenna 20, in a direction towards cover section 66. Alternatively, antenna 20 may be retracted by biasing detent member 32, which disengages detent 34 from recess 42*a* or 42*b*, and then biasing antenna 20 in a direction towards cover section 66.

While recesses 42*a* and 42*b* and corresponding detent 34 are illustrated as being rounded, it is anticipated that recesses 42*a* and 42*b* may be any shape that will engage with a correspondingly shaped detent 34. For example, recesses 42*a* and 42*b* and detent 34 may be substantially square, elliptical, triangular, and the like. It is noted that if recesses 42*a* and 42*b* and detent 34 are substantially square, antenna 20 may not be retracted and extended by biasing antenna 20 in a direction away from or towards cover section 66 (i.e., along arrow 35). In the case of substantially square recesses 42*a* and 42*b* and detent 34, detent member 32 is first biased to disengage detent 34 from recesses 42*a* and 42*b* (i.e., along arrow 33), thereby allowing extension and retraction of antenna 20.

Figure 3:
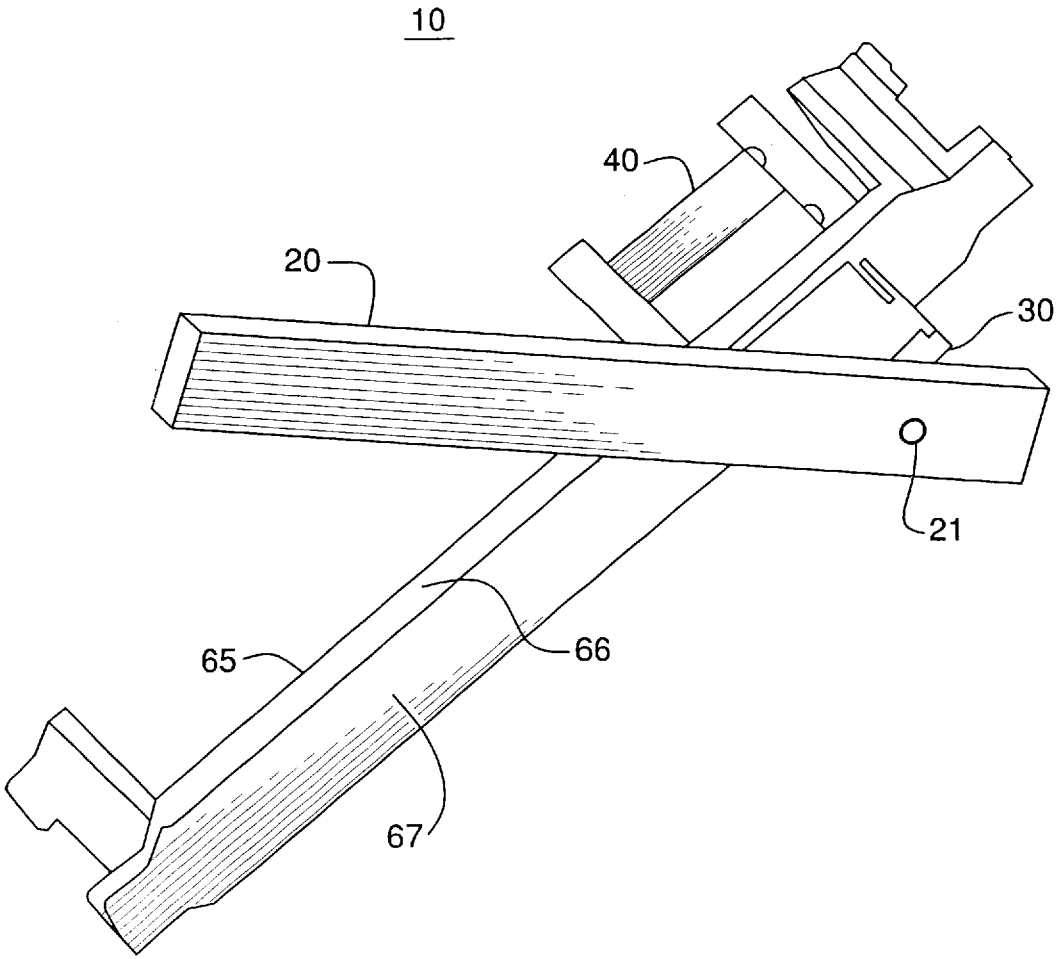
FIG. 3 is a perspective view of the assembly of FIG. 1 illustrating the antenna rotated between a travel position and a communication position, in accordance with one embodiment of the present invention.

In the retracted position, antenna 20 is located adjacent to the electronic card, thereby protecting antenna 20 from damage. In the extended position, antenna 20 is spaced apart from the electronic card allowing antenna 20 to be rotated, as is best seen in FIG. 3. The rotation allows a user to adjust the orientation of antenna 20 for optimal transmission and reception of electromagnetic waves.

Antenna 20 is rotatably coupled to exterior portion 36 of slide mechanism 30. Antenna 20 is rotatably coupled to slide mechanism 30 by hinge pin 21. In one embodiment, antenna 20 may be rotatable through 360 degrees. In another embodiment, the rotation of antenna 20 is limited by stop mechanisms (not shown) on slide mechanism 30. In this manner, the rotation of antenna 20 may be limited to, for example, 90 degrees, which may correspond to two positions. A first position is a communication position, wherein antenna 20 is rotated to be substantially perpendicular to end piece 20. A second position is a travel position, wherein antenna 20 is rotated to be substantially parallel to end piece 20. Additionally, antenna 20 may be adjusted to any position between the communication position and the travel position, for example, to optimize communications between antenna 20 and another electronic device.

Cable 50 may be coupled to antenna 20. Cable 50 includes a connector 52 at the end of cable 50 distal from antenna 20 for connection to an electronic package 54. Electronic package 54 includes a similar connector 52 for connection of cable 50 to electronic package 54, as is best seen in FIG. 5. In this manner, electronic signals may be sent between antenna 20 and electronic package 54. In one embodiment, cable 50 is formed in an s-shape to minimize cable stress due to extending and retracting slide mechanism 30.

Cable 50 may include a coaxial connector (not shown) at the end of cable 50 proximate to antenna 20. In fact, the coaxial connector could act as hinge pin 21 to allow rotation of antenna 20 relative to slide mechanism 30.

As shown in FIG. 2, slide mechanism 30 has a cable bore 51 traversing completely through slide mechanism 30 from interior portion 31 to exterior portion 36. In this manner, cable 50 may be may be displaced in cable bore 51 for coupling of cable 50 to antenna 20. Additionally, cable bore 51 may be used to secure a hinge for coupling of antenna 20 to slide mechanism 30.

Figure 7:
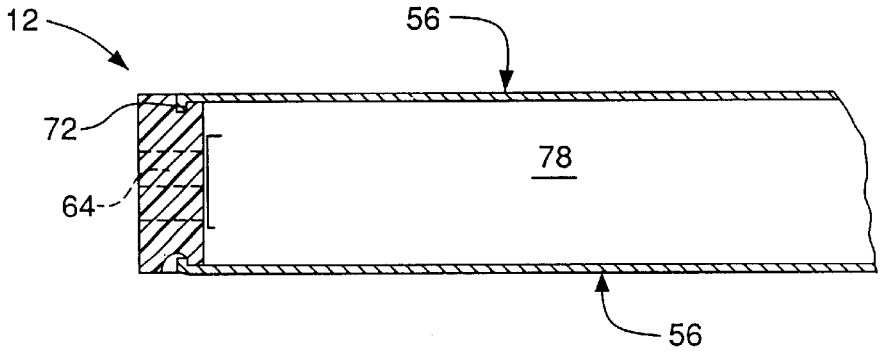
FIG. 7 is a cross-sectional view of a portion of the enclosure of FIG. 6, in accordance with one embodiment of the present invention.

As seen in FIG. 5, enclosure 90 is for enclosing electrical package 54 therein, and includes upper and lower half shells 56 that combine to define an interior cavity 78 (FIG. 7) within which electrical package 54 resides. As may be appreciated, interior cavity 58 as defined by the upper and lower half shells 56 is open at one end thereof. However, end piece 12 closes enclosure 90 at such open end, thereby enclosing electrical package 54 (i.e., a printed circuit board with components thereon) within enclosure 90 at such open end. In particular, end piece 12 is mounted to the upper and lower half shells 56 as combined to cover such open end.

In one embodiment of the present invention, enclosure 90 defines a PC card or the like. Accordingly, half shells 56 are appropriately dimensioned to conform to PCMCIA dimensional specifications (Type, I, II, or III, as appropriate) when combined. Nevertheless, enclosure 90 may define any other type of device or assembly without departing from the spirit and scope of the present invention. In one embodiment, half shells 56 are formed from a conductive material such as a stainless steel so that the enclosure acts as an electromagnetic shield, although half shells 56 may be formed from other materials, conductive or otherwise, again without departing from the spirit and scope of the present invention.

In one embodiment of the present invention, half shells 56 are similar to 'ROCARD' PC card shells, part number 83808, as designed and marketed by FCI Electronics of Etters, Pennsylvania. As should be understood, half shells 56 may be formed to include laterally arranged supports or frame bars, whereby a separate frame within interior 58 of enclosure 90 formed by such half shells 56 is not necessary. Such a lateral support could be a plastic member (not shown) extending along the latching structure on at least one side of shell 56. Accordingly, the extra space that would have been taken up within interior 58 is available for electrical package 54. Half shells 56 and enclosure 90 are more fully described in U.S. patent applications Ser. Nos. 09/297,776 and 09/578,102 and U.S. Pat. Nos. 6,058,018, entitled "Electronic Card", issued May 2, 2000, and 6,160,711, entitled "Fluid Conditioning System and Method", issued Aug. 22, 2000, hereby incorporated by reference herein.

Generally, half shells 56 are formed to be substantially identical such that any two such half shells 56 may be combined to form enclosure 90. In addition, half shells 56 include interlocking features at lateral sides thereof that securely non-releasably interlock when half shells 56 are combined to define interior cavity 58. As seen, one lateral side of each half shell 56 includes a flange at the distal portion of which are a plurality of latches, and the other lateral side of each half shell 56 includes another flange at the distal portion of which are a plurality of catches.

Thus, half shells 56 are combined to define interior cavity 58 by aligning the latches of each half shell 56 with the catches of the other half shell 56, and then compressing along the lateral sides to pressure the latches into the catches.

As may be appreciated, electrical package 54, which is secured and sandwiched between half shells 56, may be any appropriate package without departing from the spirit and scope of the present invention. Typically, electrical package 54 is a wireless LAN adapter. However, electrical package 54 may be any device using an antenna without departing from the spirit and scope of the invention. As seen, in accordance with the PCMCIA standard, each electrical package 54 is provided with a standard 68-position receptacle connector 60 at one longitudinal end thereof, although connector 60 may be omitted, substituted, or modified without departing from the spirit and scope of the present invention, for example if electrical package 54 is not a package conforming to the PCMCIA standard.

As best seen in FIG. 5, end piece 12 includes cover section 66 generally positioned at the open end of enclosure 90 to close such open end, and a pair of arms 69 that extend from cover section 66 and into interior cavity 58 of enclosure 90 as defined by half shells 56. Each arm 69 preferably extends generally along a respective groove along a lateral side of enclosure 90 as formed by half shells 56, and more preferably is shaped to conform to each of upper and lower half shells 56 as defining interior cavity 58. Thus arms 69 may both at least partially assist in providing structural integrity to enclosure 90. That is, arms 69 can resemble the aforementioned frame bars (not shown) and can assist in resisting certain forces that may be exerted on the enclosure 90 either during insertion into or withdrawal from a corresponding slot (not shown), or at other times. In addition, such arms 69 are positioned out of the way of electrical package 54. As a result, space within enclosure 90 that may be occupied by electrical package 54 is maximized.

In one embodiment of the present invention, upper and lower half shells 56 in combination define a notch at each lateral side of enclosure 90, and each arm 69 includes a finger 70 that extends into a respective notch to secure end piece 12 to upper and lower half shells 56 as combined to form enclosure 90. For example, and as shown, each half shell 56 may define a half-notch 72 at each lateral side thereof (FIG. 5) such that half-notches 72 in combination (broken-away portion of FIG. 6) form the notches at each lateral side of enclosure 90. As seen, each notch as formed by half-notches 72 or otherwise is adjacent and opens into interior cavity 58, and each finger 70 extends away from the other finger 70 and into the respective notch.

To construct enclosure 90 with electrical package 54 and end piece 12, half shells 56 are combined to define enclosure 90 and interior cavity 58 thereof within which electrical package 54 resides, and end piece 12 is mounted to half shells 56 to cover the open end of interior cavity 58 and close electrical package 54 within enclosure 90 at such open end. In one embodiment of the present invention, and in particular, such mounting and combining is accomplished by firstly positioning end piece 12 between half shells 56, as shown by the arrow 1 in FIG. 5, and then secondly securing half shells 56 together to thereby retain the positioned end piece 12 therebetween, as shown by the arrows 2 in FIG. 5. As seen in FIG. 5, and as should be evident, electrical package 54 is also positioned between half shells 56 and is subsequently sandwiched within interior cavity 58 of enclosure 90 formed by securing half shells 56 together.

Figure 8:
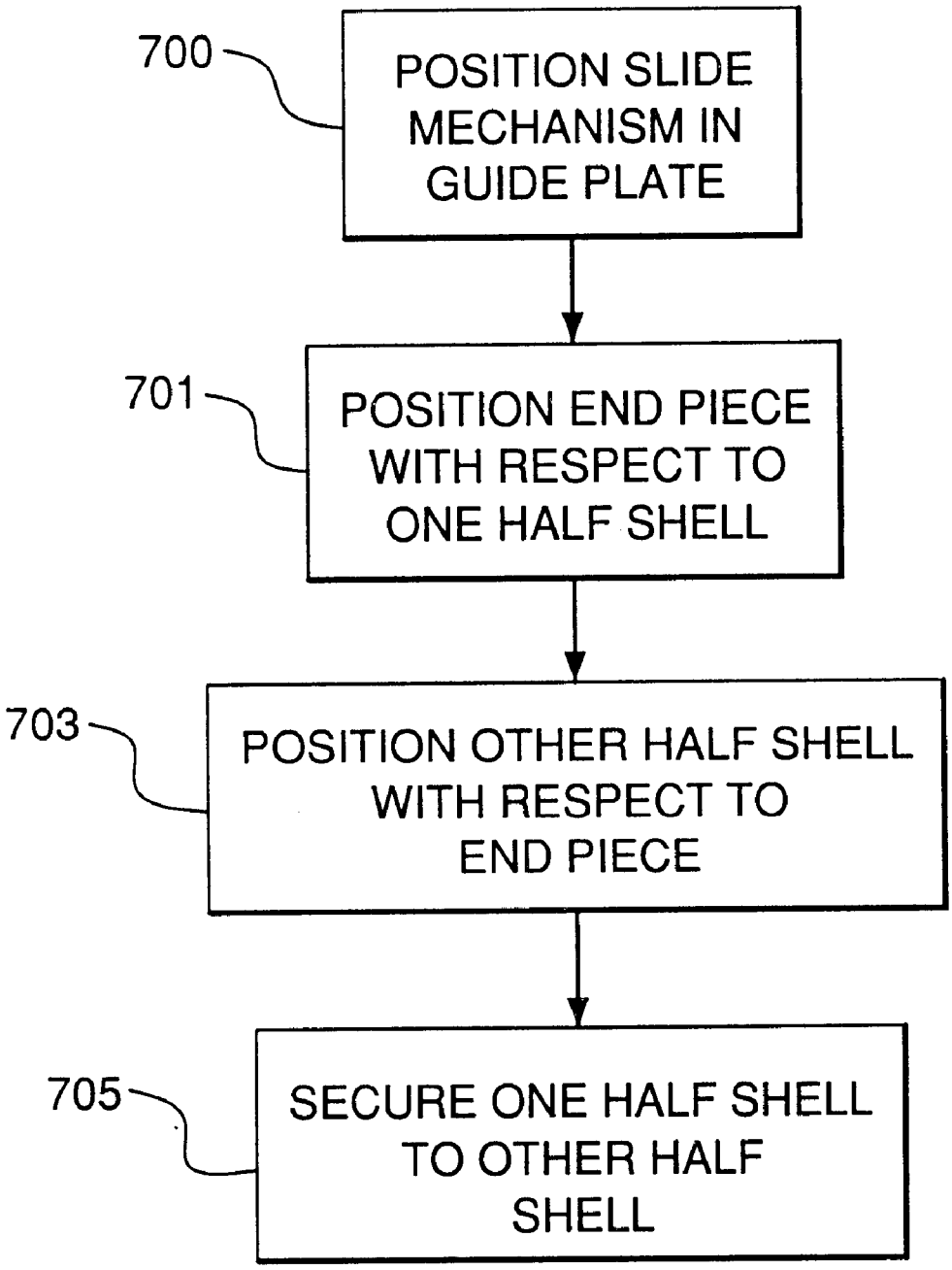
FIG. 8 is a flow chart detailing steps performed in forming the enclosure of FIG. 6 in accordance with one embodiment of the present invention.

Of course, the various individual elements must be properly arranged and aligned during the aforementioned positioning and combining. In one embodiment of the present invention, and referring now to FIG. 8, end piece 12 is appropriately positioned with respect to lower half shell 56 such that fingers 70 are properly aligned with half-notches 72 of lower half shell 56 (step 701), and upper half shell 56 is appropriately positioned with respect to lower half shell 56 and positioned end piece 12 such that fingers 70 are properly aligned with half-notches 72 of upper half shell 56 (step 703). Of course, either earlier or at the same time, electrical package 54 is also appropriately positioned with respect to upper and lower half shells 56. Thereafter, positioned upper half shell 56 and lower half shell 56 are secured together to thereby retain the positioned end piece 12 and electrical package 54 therebetween (step 705). In the case of the aforementioned latches and catches at the lateral sides of the half shells, such securing may take place by the appropriate application of suitable pressure to engage the latches to the corresponding catches.

In the foregoing description, it can be seen that the present invention comprises a new and useful antenna that allows adjustment of the orientation of the antenna with respect to the electronic device, such as a notebook computer and also protects the antenna when not in use. It should be appreciated that changes could be made to the embodiments described above without departing from the inventive concepts thereof. It should be understood, therefore, that this invention is not limited to the particular embodiments disclosed, but it is intended to cover modifications within the spirit and scope of the present invention as defined by the appended claims.

What is claimed is:

1. An assembly for an electronic card, comprising:

an end piece for connection to said electronic card, said end piece having an internal side and an external side, said end piece including an aperture;

a guide plate coupled to said internal side of said end piece and adjacent to said aperture, said guide plate having a first recess and a second recess;

a slide mechanism located at least partially in said guide plate, said slide mechanism including a detent, said slide mechanism having an extended position and a retracted position, in said extended position said detent is engaged in said second recess, in said retracted position said detent is engaged in said first recess, wherein disengaging said detent from either of said first recess and said second recess allows sliding said slide mechanism between said extended position and said retracted position; and a member rotatably coupled to said slide mechanism.

2. The assembly of claim 1 wherein said member is an antenna.

3. The assembly of claim 2 wherein said antenna is coupled to said slide mechanism with a hinge pin.

4. The assembly of claim 2 wherein said antenna is coupled to said slide mechanism with a coaxial connector.

5. The assembly of claim 2 further comprising a cable coupled to said antenna.

6. The assembly of claim 5 wherein said slide mechanism has a bore for connection of said cable to said antenna.

7. The assembly of claim 1 wherein said end piece and said guide plate are a substantially unitary body.

8. The assembly of claim 1 wherein said guide plate has a void contiguous with said aperture for receiving said slide mechanism.

9. The assembly of claim 8 wherein said slide mechanism and said void are substantially rectangular.

10. The assembly of claim 1 wherein the first recess is distal from said end piece and said second recess is proximate to said end piece.

11. The assembly of claim 1 wherein said slide mechanism includes a plurality of detents.

12. The assembly of claim 1 wherein said detent is coupled to said slide mechanism via a detent member.

13. The assembly of claim 1 wherein said detent is coupled to said slide mechanism via a spring.

14. The assembly of claim 1 wherein said detent is partially compliant.

15. The assembly of claim 1 wherein said detent and said first and second recesses are rounded.

16. The assembly of claim 1 wherein said end piece includes a pair of arms extending from said internal side of said end piece.

17. The assembly of claim 1 further comprising an enclosure having an open end.

18. The assembly of claim 17 wherein said enclosure has a pair of opposing lateral sides, wherein each of said pair of arms extends generally along a respective lateral side of said enclosure.

19. The assembly of claim 17 wherein said enclosure comprises two half shells.

20. The assembly of claim 19 wherein each of said pair of arms is shaped to conform to each said half shell as defining an interior cavity, thereby at least partially providing structural integrity to said enclosure.

21. The assembly of claim 19 wherein said half shells in combination define a notch at each lateral side of said enclosure and wherein each of said pair of arms includes a finger extending into a respective notch to secure said end piece to said half shells as combined.

22. The assembly of claim 17 wherein said end piece substantially completely covers said open end of said enclosure.

23. The assembly of claim 17 wherein said enclosure is constructed according to a PCMCIA standard.

24. A method for assembling an electronic card having an antenna, the method comprising:

placing a slide mechanism in a guide plate of an end piece, said slide mechanism being coupled to a rotatable member;

combining a pair of half shells to define an interior cavity within which an electrical package resides, said interior cavity as defined by said half shells being open at one end thereof; and mounting said end piece to said half shells to cover said open end of said interior cavity and close said electrical package within said enclosure at such open end.

25. The method of claim 24 wherein the rotatable member is an antenna.

26. The method of claim 24 further comprising:

positioning said end piece between said half shells; and securing said half shells together to thereby retain said positioned end piece therebetween.

27. The method of claim 26 further comprising:

positioning said end piece with respect to one half shell;

positioning the other half shell with respect to said one half shell and said positioned end piece; and securing said positioned other half shell and said one half shell together to thereby retain said positioned end piece therebetween.

28. An antenna assembly for an electronic device, said antenna assembly comprising:

an end piece having first and second latch fingers at opposite ends thereof and an aperture between said ends;

a slide mechanism slideably coupled to said end piece and translatable through said aperture between a retracted position and an extended position; and an antenna rotatably coupled to a distal end of said slide mechanism, said antenna being proximate said end piece while said slide mechanism is in said retracted position and being spaced apart from said end piece while said slide mechanism is in said extended position.

29. The antenna assembly of claim 28, wherein said antenna is coupled to said slide mechanism with a hinge pin.

30. The antenna assembly of claim 28, wherein said antenna is coupled to said slide mechanism with a coaxial connector.

31. The antenna assembly of claim 28, wherein said slide mechanism has a bore for connection of a cable to said antenna.

32. The antenna assembly of claim 28, wherein said antenna assembly is constructed according to a PCMCIA standard.

33. The antenna assembly of claim 28, wherein the electronic device is a computer.

34. The antenna assembly of claim 28, further comprising a wireless network adapter in communication with said antenna.

35. The antenna assembly of claim 34, wherein said wireless network adapter is a wireless local area network adapter.

36. The antenna assembly of claim 28, further comprising a guide plate slidably coupled to said slide mechanism.

37. A removable electronic card assembly for an electronic device, said card assembly comprising:

a housing having an open end;

an end piece fixedly and mechanically coupled in said open end of the housing and substantially closing said open end, said end piece having an aperture; and an antenna assembly rotatably and slidably coupled to said end piece and passing through said aperture of said end piece, said antenna assembly including an antenna portion being proximate said end of said housing while said antenna assembly is in a retracted position and being spaced apart from said end of said housing while said antenna assembly is in an extended position.

38. The removable electronic card assembly of claim 37, wherein said card assembly is constructed according to a PCMCIA standard.

* * * * *